US007665469B1

(12) United States Patent
Behipour

(10) Patent No.: US 7,665,469 B1
(45) Date of Patent: Feb. 23, 2010

(54) CIGARETTE AND TOBACCO PACKING MACHINE

(76) Inventor: Behyar Behipour, 4205 Donavan Dr., Columbia, SC (US) 29210

( * ) Notice: Subject to any disclaimer, the term of this patent is extended or adjusted under 35 U.S.C. 154(b) by 699 days.

(21) Appl. No.: 11/453,943

(22) Filed: Jun. 15, 2006

(51) Int. Cl.
*A24C 1/18* (2006.01)

(52) U.S. Cl. ..... 131/283; 131/70

(58) Field of Classification Search ..... 131/283, 131/70, 905–907
See application file for complete search history.

(56) References Cited

U.S. PATENT DOCUMENTS

| | | | | |
|---|---|---|---|---|
| 681,463 | A | 8/1901 | Waite | |
| 2,699,787 | A * | 1/1955 | Kastner | 131/70 |
| 3,127,900 | A * | 4/1964 | Kastner | 131/70 |
| 3,202,156 | A * | 8/1965 | Kappeler et al. | 131/70 |
| 3,688,777 | A * | 9/1972 | Kastner et al. | 131/70 |
| 4,361,140 | A | 11/1982 | Barkalow | |
| 4,457,125 | A | 7/1984 | Fishburne | |
| 4,572,065 | A | 2/1986 | Fishburne | |
| 5,009,237 | A * | 4/1991 | Schmidt et al. | 131/70 |
| 5,076,261 | A | 12/1991 | Black | |
| 5,088,506 | A * | 2/1992 | Kastner | 131/70 |
| 5,088,507 | A * | 2/1992 | Baker et al. | 131/280 |
| 5,450,861 | A * | 9/1995 | Colani | 131/70 |
| 6,095,151 | A | 8/2000 | Arthur | |
| 2004/0255962 | A1 * | 12/2004 | Moser et al. | 131/70 |
| 2007/0295343 | A1 * | 12/2007 | Susanto et al. | 131/58 |

FOREIGN PATENT DOCUMENTS

EP 126602 A1 * 11/1984

* cited by examiner

*Primary Examiner*—Carlos Lopez
(74) *Attorney, Agent, or Firm*—Lawrence J. Gibney, Jr.

(57) ABSTRACT

This is a device to pack cigarettes into a standard cigarette pack. It is designed to be portable and is comprised of a series of wheels, which are located in the interior of the casing. A handle on the outside of the device rotates a wheel, which in turn rotates another wheel and allows the device to operate.

3 Claims, 2 Drawing Sheets

CIGARETTE AND TOBACCO PACKING MACHINE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to packing cigarettes in a pack. This is not a sorter of cigarettes but is merely a packer of cigarettes in a standard package.

B. Prior Art

Other cigarette packing devices exist in the prior art. Some examples of these include Arthur U.S. Pat. No. 6,095,151, Fishburne, U.S. Pat. No. 4,457,125 and Barkalow U.S. Pat. No. 4,361,140. While the prior art does achieve the same result as the present device the structure of the devices that are found in the prior art are completely different than the present device.

BRIEF SUMMARY OF THE INVENTION

This relates to the packaging of tobacco products and in particular cigarettes. The device rests on a base over which rests a casing. Within the casing are a series of wheels, which are connected together by a belt or pulley. A handle, which is located on the outside of the casing provides rotation for one of the wheels.

One of the wheels is provided with a series of cams or raised portions. As this wheel rotates, it forces the packing device to move up and down. On one end of the packer is a spring, which secures the end of the packer to the cavity and maintains proper alignment. On the opposite end of the packer is a solid piece to pack the cigarettes into the pack.

A means to secure the cigarette pack on the base is provided.

It is an object to create a device that will allow an individual to pack cigarettes into an individual pack.

DETAILED DESCRIPTION OF THE EMBODIMENT

Figure 1:
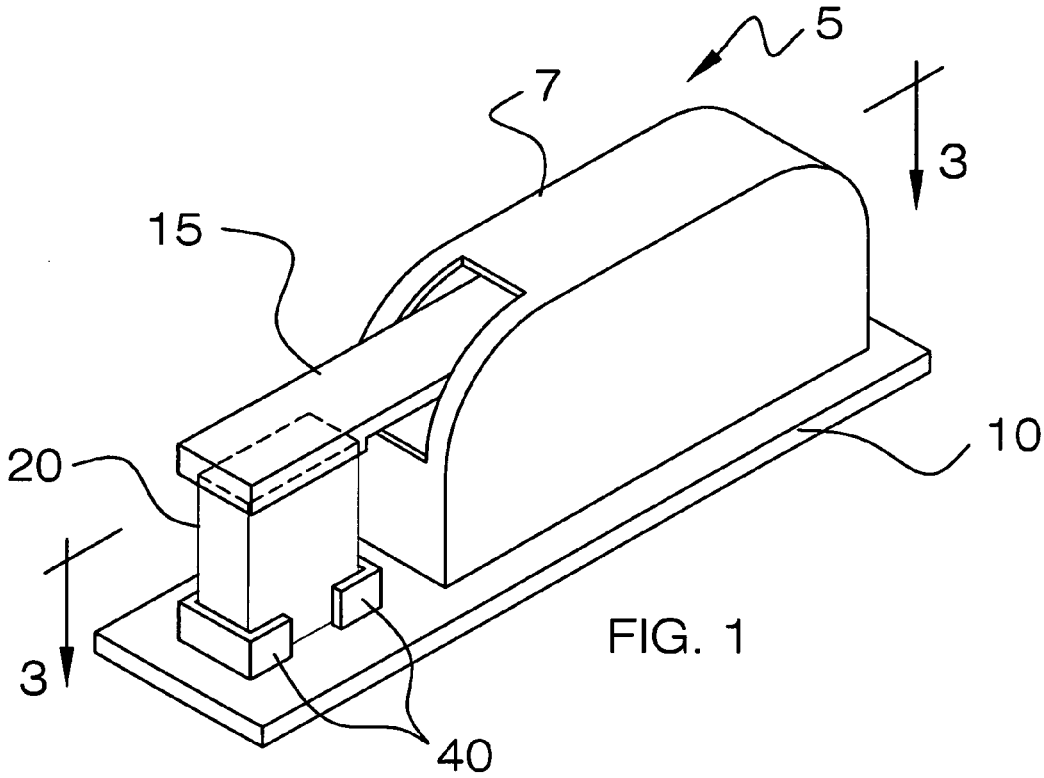
FIG. 1 is a front isometric view of the device.
Figure 2:
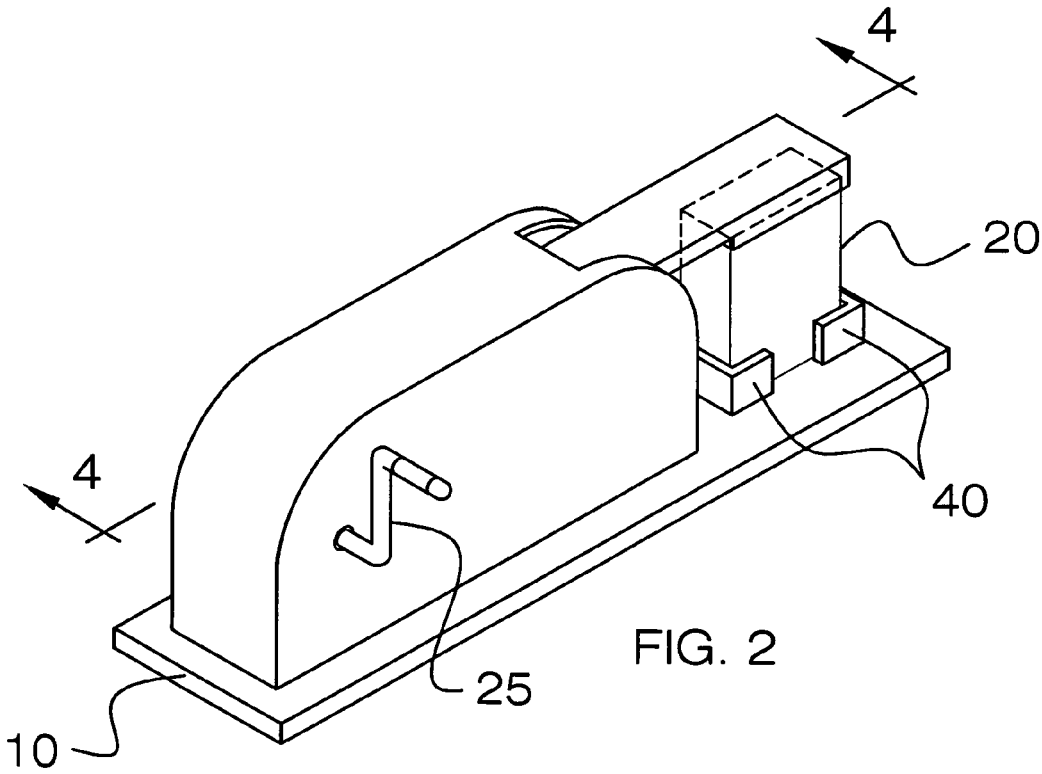
FIG. 2 is a back isometric view of the device.
Figure 3:
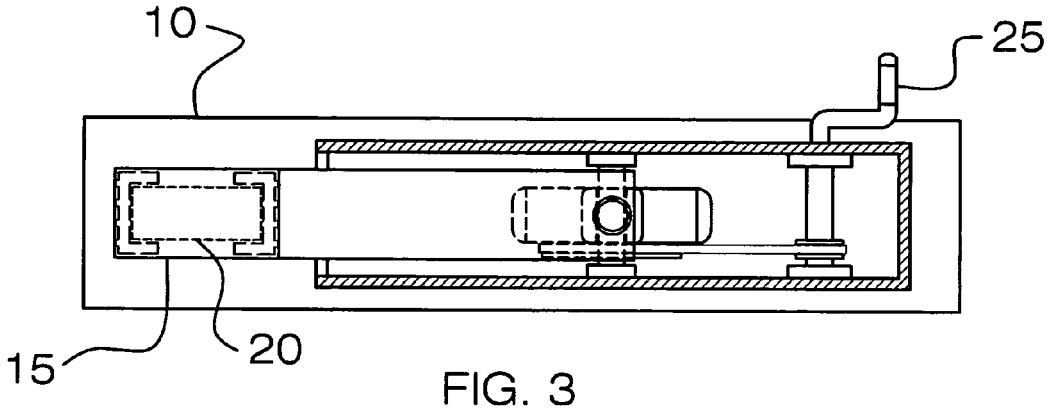
FIG. 3 is a view according to line 3-3 on FIG. 1.
Figure 4:
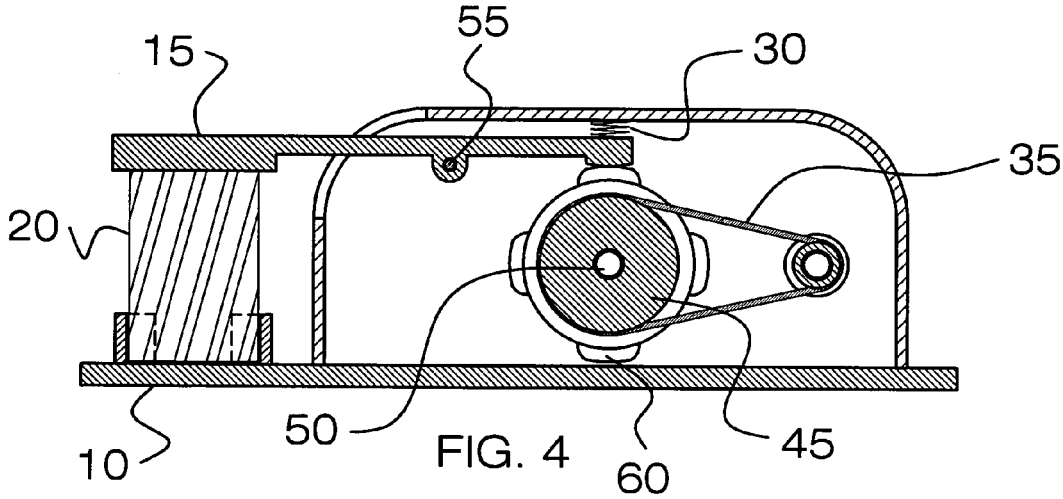
FIG. 4 is a view according to line 4-4 on FIG. 2.

This device 5 is a tobacco packer. It rests on a base 10 which is flat. A casing 7 is secured to the base 10. FIG. 1, 2 Within the body of the casing 7 is a packer wheel 45 with a series of raised surfaces 60. A wheel handle 47 is connected to a handle 25 and a packer wheel 45 are connected together by a pulley or belt 35. FIG. 4, 5

The handle 25 is located outside the casing 7 and is connected to the handle wheel 47. As the handle 25 is rotated it turns the belt 35, which in turn rotates the packer wheel 45. FIG. 4, 5 Along the perimeter of the packer wheel 45 are raised surfaces or cams 60 which are raised surfaces on the outer surface of the packer wheel 45. The packer wheel 45 is secured to the interior of the casing, probably by a pin 50. On the top surface of the packer wheel 45 is a packer arm 15. The packer arm 15 is a long, essentially planar member, which is secured to the device using a hinge pin 55. FIG. 4

Figure 5:
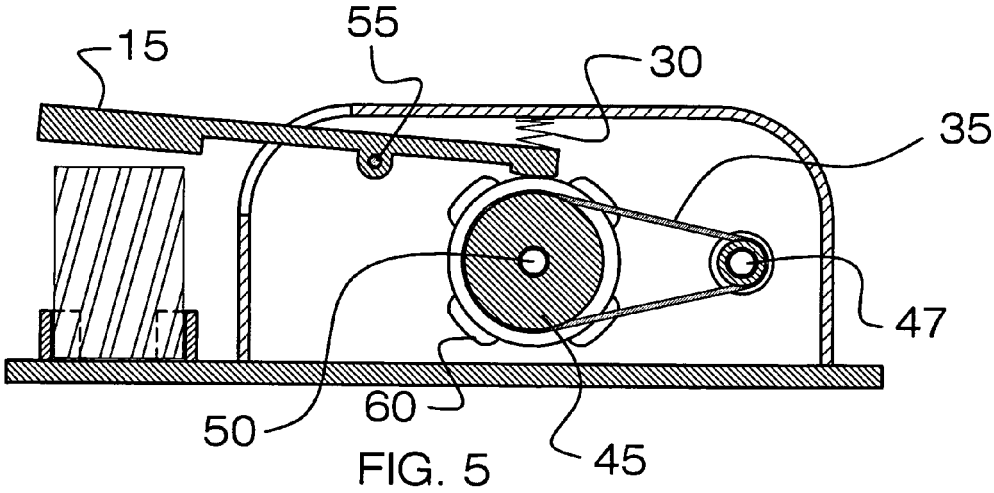
FIG. 5 is a representation of the device in operation.

A spring 30 is connected to the underside of the interior of the casing 7 and one end of the packer arm 15. As the packer wheel 45 is rotated the packer 15 will move up and down rotating around the pin 55. FIG. 5 As one end of the packer arm 15 strikes the cam 60 it rotates around the hinge pin 55 to raise or lower the packer arm 15. One end of the packer arm 15 is configured to the general shape of the top surface of a cigarette pack. The pack of cigarettes 20 is secured in position using the placement means 40, which are secured to the base 10. FIG. 1, 2

The placement means 40 is of predetermined configuration to allow a standard pack of cigarettes to be inserted in the space provided. The configuration of the placement means 40 may be rigid or adjustable depending on the size of the pack of cigarettes.

Because of the exposure to sometimes odious materials the device should be constructed of durable material such as plastic or wood.

The inventor claims:

1. A cigarette or tobacco packer which is comprised of:
a. casing;
wherein the casing protects the internal components of the device;
b. base;
wherein the casing is secured to the base;
wherein a placement means is secured to the base;
c. the placement means;
wherein the placement means is of a predetermined configuration to secure a standard pack of cigarettes to the base;
d. handle;
wherein the handle is outside the casing and is allowed to rotate;
e. handle wheel;
wherein the wheel for the handle is connected to the handle;
f. packer wheel;
wherein a means of connection for the packer wheel and the handle wheel are provided;
wherein a hinge pin secures the packer wheel to the interior of the casing;
wherein the handle wheel and packer wheel are secured together with a pulley;
g. cams;
wherein a plurality of cams is affixed to the outer surface of the packer wheel;
h. packer arm;
wherein a means to secure the packer arm is provided;
wherein the first end of the packer arm is secured to the interior of the casing;
i. spring;
wherein a spring is secured to the interior of the casing;
wherein the spring allows the packer arm to move in a generally up and down direction depending on the configuration of the packer wheel and the cam relative to one end of the packer arm.

2. The placement means as described in claim 1 is rigid.

3. The placement means as described in claim 1 is adjustable.

* * * * *